United States Patent [19]

McCrea

[11] Patent Number: 5,038,476

[45] Date of Patent: Aug. 13, 1991

[54] SIPPING SPOON

[76] Inventor: James W. McCrea, 13 Delafield Dr., Albany, N.Y. 12205

[21] Appl. No.: 341,824

[22] Filed: Apr. 24, 1989

[51] Int. Cl.[5] ..... A47J 43/28

[52] U.S. Cl. ..... 30/141; 30/123; 239/571

[58] Field of Search ..... 30/141; 206/216; 229/1.5 C; 239/33, 571, 572, 574

[56] References Cited

U.S. PATENT DOCUMENTS

| | | | |
|---|---|---|---|
| 580,527 | 4/1897 | Martin . | |
| 674,446 | 5/1901 | Marx | 30/141 |
| 1,204,171 | 11/1916 | McKay . | |
| 1,490,785 | 4/1924 | Purnell . | |
| 1,666,106 | 4/1928 | Norman . | |
| 1,813,285 | 7/1931 | Galetschky . | |
| 2,453,525 | 11/1948 | McNeill . | |
| 2,859,515 | 11/1958 | Kinman | 30/141 |
| 3,038,256 | 6/1962 | Mayer | 30/141 |
| 3,438,527 | 4/1969 | Gamblin, Jr. | 239/33 X |
| 3,461,554 | 8/1969 | Aykanian | 30/141 |
| 3,648,369 | 3/1972 | Frodsham | 30/141 |
| 3,925,890 | 12/1975 | Frodsham | 30/141 |
| 4,196,747 | 4/1980 | Quiqley et al. | 239/33 X |

*Primary Examiner*—Douglas D. Watts
*Assistant Examiner*—Rinaldi Rada
*Attorney, Agent, or Firm*—Schmeiser, Morelle & Watts

[57] ABSTRACT

A spoon with a bowl at one end, an internal duct from the bowl to the mouth end, and a widened lip at point of consumption. The bowl is shaped in the general form of a traditional spoon. The sipping spoon permits solid food or fluid to be carried in the bowl end of the spoon and transported to point of consumption; or, the spoon permits fluid being drawn through an internal conduit to the consumption point at the handle/mouth end of the spoon. The internal duct begins at the base/bowl of the spoon, extends up through the shaft, and ends at the lip of the spoon. An internal baffle eases continued draft by suction and prevents fluid flow when the baffle is in the quiescent state.

3 Claims, 1 Drawing Sheet

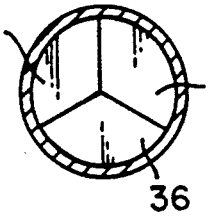
FIG. 3A
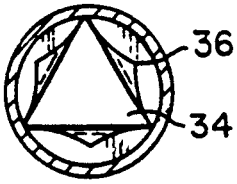
FIG. 3B
FIG. 4
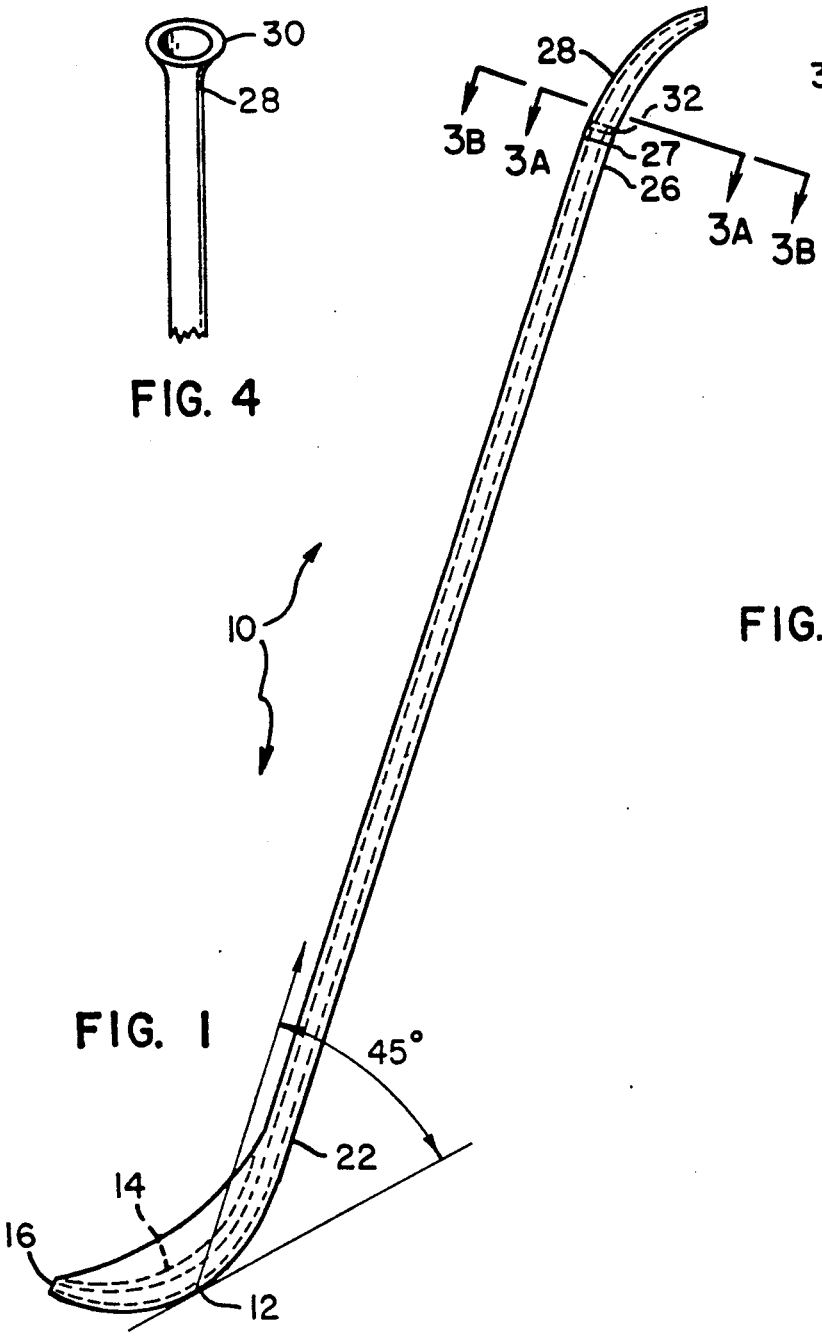
FIG. 1
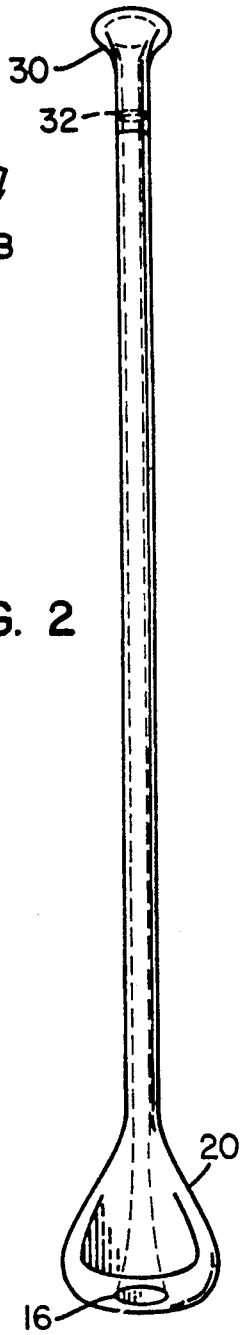
FIG. 2

SIPPING SPOON

FIELD OF THE INVENTION

This invention relates to the confectionery, restaurant, and culinary fields. More specifically, this invention is a spoon with an internal duct for sipping through the spoon and is appropriate for use by: consumers of ice cream sodas; patrons at restaurants and taverns; and, chefs and other preparers of processed foods. The invention also relates to use where foods and fluids are served, such as: hospitals, nursing homes, and vocational rehabilitation centers.

BACKGROUND OF THE INVENTION AND PRIOR ART

A number of inventions have been made in the field of eating utensils and straws which offer alternatives to prior limitations of food and fluid movements. In a patent issued to Aykanian in 1969, U.S. Pat. No. 3,461,554, an invention was presented that offered a combination drinking straw and spoon. The implement, however, was fashioned in shape from a traditional straw mold, and end-cut so as to permit an upward bending to resemble, in part, a spoon. The device could always be utilized as a straw, but, only in part, as a spoon. In 1972, U.S. Pat. No. 3,648,369 was issued to Frodsham, which displayed an invention which attached or bonded a flat blade to the end of a straw. Finally, in 1975, Huntington was awarded U.S. Pat. No. 3,925,890, which presented a plastic spoon attachment into which a soda straw could fit.

While, the last two inventions offered the advantage of a more stable blade end, they did not address the traditional expectations of food consumers and users of eating utensils. The traditional shape of the spoon was sacrificed in the development of the inventions in meeting the preceived need as viewed by the inventors. This was also the case with the Aykanian invention. My invention, however, overcomes these past shortfalls by: offering a new eating implement which employs the shape of the traditional spoon, but creating within the spoon itself an internal duct/conduit for fluid movement; and inserting a baffle gate, designed as an improvement specifically for the sipping-spoon, which prevents fluid backflow that would foul container contents. The baffle gate also prevents leaking of the duct contents when the spoon is lifted by the handle and the spoon used to consume the food held in the spoon bowl. The entirely-new invention and the significant improvement of the baffle as applied to the eating utensil art give my invention an important place in the eating utensil field of art.

SUMMARY OF THE INVENTION

This invention contemplates the use of a traditionally-shaped spoon, widened for an internal duct, to allow alternate means of consumption: by spoon-bowl conveyance or by sipping/suction. My invention conforms to the usual shape of the mouth while eating. The bowl of the spoon is shaped in the traditional fashion; and the lip of the spoon stem is rimmed to accommodate either pursed or relaxed lips. The salient characteristic of the sipping-spoon is the internal duct. It is slightly-widened at the orifice at the base of the spoon and follows the general shape of the spoon: that is, the conduit bends up to and through the straight shaft, and then bends in the opposite direction into the stem and ends at a slightly-widened opening at the lip of the sipping-spoon.

Between the intake orifice and the outflow exit of the conduit, a baffle is located to prevent fluid backflow. The one-way design stops the liquid from re-entering or fouling the fluid containing means. My invention brings the liquid content to the consumer with less time and suction, and keeps the contents of the container fresh and unsoiled. The baffle has alternate and usual forms of application from various fields of art: medical, plumbing, boiler. The baffle may be structured as a single waffer, slit in center to permit fluid passage under suction. Alternately, the center passage through the waffer may be designed as a flapover waffer. Alternately, a partial air barrier may be created by the utilization of a screen mesh waffer. In the preferred embodiment, the sipping-spoon baffle is tricuspid, maintaining an airlock to prevent fluid backflow, while, at the same time, permitting a fluid passage which responds to upward suction. The passage width is a function of the measure of the triangular sides of the equilateral tricuspid opening.

The baffle placement can be made at any location upward from the bowl of the sipping-spoon. The preferred embodiment location is near the top-end of the shaft, at the stem. The embodiment maintains maximum fluid content in the sipping-spoon, without loss through the mouth orifice from stem curvature and gravity.

The baffle may be designed for location in usual and alternative methods. It can be manufactured as integral mold to the bowl end of the sipping spoon, or as mold to the mouth end. Alternatively, the baffle may be a separate third section, attached to either end section by pressure snap, or threaded neck, or crimped and reduced diameter end for male insertion into female section. In the preferred embodiment, the baffle is molded at the stem connection of the mouth end. The preferred embodiment allows for multiple uses by the same consumer or many consumers, where a new mouth end can be substituted and the used mouth end discarded. Thus, for example, should the bowl end of the sipping-spoon be manufactured of metal to allow for later cleaning and reuse, a replaced mouth end could be utilized by a hospital patient for oral medications or by professional handlers for drafting out different levels of foods under process.

Although the descriptions above contain many specificities, these should not be construed as limiting the scope of the invention but as merely providing illustrations of some of the objects and of the embodiments. For example, the bowl can have other shapes, such as circular, oval, etc.; the fit of the shaft-stem can have other shapes; the stem en can be eliminated as a separate section by unimolding, etc.

BRIEF DESCRIPTION OF THE DRAWINGS

Of the drawings:

FIG. 1 is a side elevational view of the invention showing the internal duct and baffle;

FIG. 2 is a top plan view of the invention laying on both bowl and mouth ends;

FIGS. 3*a–b* section view of baffle detail taken along lines A—A of FIG. 1;

FIG. 4 is a section view of the rear of the mouth end of the invention.

DETAILED DESCRIPTION OF THE PREFERRED EMBODIMENT

Reference to FIG. 1, there is depicted an isometric illustration of the invention 10, the base 12 of the bowl 14 concave to the upper human lip and convex to the lower human lip, is oval 20 when presented in a plan view FIG. 2. The distance between the concave and convex walls, or the thickness of the spoon, is the measure of the diameter of the internal duct plus the spoon material construction.

The spoon rises in curvilinear shape FIG. 1, narrowing to the base of the shaft 22; the internal duct similarly narrows to a flue. The flue, now shaped by the shaft, rises at a 45 degree line from the perpendicular at the furthest length of the shaft is a function of standard commercial designs, where the length accommodates the various sizes of fluid containers.

At the top neck 26 of the shaft, the stem 28 follows a curvilinear line, where the concave-convex design is in opposite configuration to the bowl. The stem widens slightly at the mouth 30 of the invention.

Baffle 32 is locked between neck 26 and stem 28. More specifically, the baffle 32 is placed at the end of neck 26 at 27. The stem is then inserted over neck 26 securing the baffle therebetween. Of course, if desired this feature can be repeated if it is desireable to add another baffle, for example, at the other end.

The baffle means 32 in FIG. 1 is displayed in the preferred embodiment in FIG. 3A and FIG. 3B. FIG. 3A presents the tricuspid valve in a closed position, securing an air lock, preventing fluid backflow. FIG. 3B displays the position of the tricuspid flaps 36 in the open position, when suction is applied to the mouth end of the spoon causing the flaps to open, the air lock to be broken, and the fluid to begin or continue a one-way flow from orifice at the base, upward along the flue, up over the stem, and exiting at the opening at the handle/-mouth end of the spoon. The flaps are made of pliable means material, such as a thin plastic, which when open give the appearance of a triangle 34. The passage width is a function of the measure of the triangular sides of the equilateral-type tricuspid opening.

It should be appreciated that the actual construction of the spoon may be formed in any one of a variety of arrangements. Thus the scope of the invention should be determined by the appended claims rather than by the variations provided.

What is claimed is:

1. An oral consumption implement comprising:

a spoon having a shaft and a spoon bowl located at a first end of the shaft;

conduit through said shaft;

an intake orifice toward the end of the shaft having said spoon bowl said intake orifice communicating with one end of said conduit;

a mouth engaging portion at a second end of the shaft said mouth engaging portion having an outflow exit communicating with said conduit;

a baffle secured between said intake orifice and said outflow exit, said baffle movable between an open and closed position said baffle biased to the closed position with sufficient force to retain the liquid in the conduit and prevent liquid flow through the outflow exit when the spoon bowl is lifted up to a users mouth, said baffle overcoming said bias and moving to an open position when suction is applied to the mouth engaging portion.

2. The invention of claim 1 wherein said baffle is located toward said mouth engaging portion.

3. The invention of claim 2 wherein said mouth engaging portion is a removable stem having a curvilinear shape opposite in direction to the shape of said spoon bowl.

* * * * *